US012704253B2

(12) United States Patent
Alecu et al.

(10) Patent No.: US 12,704,253 B2
(45) Date of Patent: Aug. 11, 2026

(54) BURNER FOR AN AIRCRAFT GAS TURBINE ENGINE

(71) Applicant: Pratt & Whitney Canada Corp., Quebec (CA)

(72) Inventors: Daniel Alecu, Brampton (CA); Laslo T. Diosady, Etobicoke (CA)

(73) Assignee: PRATT & WHITNEY CANADA CORP., Longueuil (CA)

( * ) Notice: Subject to any disclaimer, the term of this patent is extended or adjusted under 35 U.S.C. 154(b) by 374 days.

(21) Appl. No.: 18/233,159

(22) Filed: Aug. 11, 2023

(65) Prior Publication Data

US 2025/0052418 A1 Feb. 13, 2025

(51) Int. Cl.
*F23D 14/58* (2006.01)
*F23D 14/34* (2006.01)

(52) U.S. Cl.
CPC ..... *F23D 14/58* (2013.01); *F23D 14/34* (2013.01)

(58) Field of Classification Search
CPC ..... F23D 14/58; F23D 14/34; F23C 5/06
USPC ..... 431/2, 189
See application file for complete search history.

(56) References Cited

U.S. PATENT DOCUMENTS 915,991 A * 3/1909 Morrison et al. ..... F23D 11/10 431/186
2,594,797 A * 4/1952 Plass ..... F23D 14/00 431/185
5,292,244 A * 3/1994 Xiong ..... B01F 25/3131 431/189
6,162,049 A * 12/2000 Pellizzari ..... F23D 14/70 60/749
2006/0260316 A1 11/2006 Stuttaford
2014/0182294 A1 7/2014 Matsumoto
2022/0349342 A1 11/2022 Giridharan
2022/0412551 A1 12/2022 Zink

FOREIGN PATENT DOCUMENTS

DE 19917662 A1 11/2000
EP 2503241 A1 9/2012
JP 56077607 A 6/1981

OTHER PUBLICATIONS

EP Search Report for EP Patent Application No. 24193971.9 dated Feb. 26, 2025.

* cited by examiner

*Primary Examiner* — Vivek K Shirsat
(74) *Attorney, Agent, or Firm* — Getz Balich LLC

(57) ABSTRACT

An assembly for a gas turbine engine includes at least one burner and a hydrogen manifold. The at least one burner includes an outer nozzle and an inner nozzle. The outer nozzle forms a combustion chamber. The outer nozzle includes an outer converging axial portion and an outer diverging axial portion. The outer converging axial portion is disposed at an upstream axial end of the outer nozzle. The outer diverging axial portion is disposed axially downstream of the outer converging axial portion. The inner nozzle includes an inner converging axial portion at a downstream axial end of the inner nozzle. The inner converging axial portion is disposed within the outer converging axial portion to form an annular gap between the outer converging axial portion and the inner converging axial portion. The hydrogen manifold is disposed at the upstream axial end. The hydrogen manifold is connected in fluid communication with the annular gap.

18 Claims, 3 Drawing Sheets

BURNER FOR AN AIRCRAFT GAS TURBINE ENGINE

TECHNICAL FIELD

This disclosure relates generally to a combustor section of an aircraft propulsion system and, more particularly, to a burner configured for use with a hydrogen fuel.

BACKGROUND OF THE ART

Engines for aircraft propulsion systems include combustion equipment configured to extract energy from combustion of fuels. Various types and configurations burners and other combustion equipment are known in the art. While these known burners have various advantages, there is still room in the art for improvement. There is a need in the art, therefore, for an improved burner for an aircraft propulsion system.

SUMMARY

It should be understood that any or all of the features or embodiments described herein can be used or combined in any combination with each and every other feature or embodiment described herein unless expressly noted otherwise.

According to an aspect of the present disclosure, an assembly for a gas turbine engine includes at least one burner and a hydrogen manifold. The at least one burner includes an outer nozzle and an inner nozzle. The outer nozzle extends circumferentially about an axial centerline to form a combustion chamber within the outer nozzle. The outer nozzle includes an outer converging axial portion and an outer diverging axial portion. The outer converging axial portion is disposed at an upstream axial end of the outer nozzle. The outer diverging axial portion is disposed axially downstream of the outer converging axial portion. The inner nozzle extends circumferentially about the axial centerline. The inner nozzle includes an inner converging axial portion at a downstream axial end of the inner nozzle. The inner converging axial portion is disposed within the outer converging axial portion to form an annular gap between the outer converging axial portion and the inner converging axial portion. The hydrogen manifold is disposed at the upstream axial end. The hydrogen manifold is connected in fluid communication with the annular gap.

In any of the aspects or embodiments described above and herein, the outer converging axial portion may extend between and to a first axial end and a second axial end. The downstream axial end may be disposed axially between the first axial end and the second axial end.

In any of the aspects or embodiments described above and herein, the assembly may further include a compressor section of the gas turbine engine. The inner nozzle may surround and form an air passage along the axial centerline. The inner nozzle may be connected in fluid communication with the compressor section and may be configured to direct a compressed air from the compressor section into the combustion chamber through the air passage.

In any of the aspects or embodiments described above and herein, the outer diverging axial portion may extend between and to a first axial end and a second axial end. The first axial end may be disposed at the outer converging axial portion.

In any of the aspects or embodiments described above and herein, the outer nozzle may form a continuous curvature surface at an intersection of the outer diverging axial portion and the outer converging axial portion.

In any of the aspects or embodiments described above and herein, the outer converging portion may include an outer converging surface. The inner converging axial portion may include an inner converging surface. The outer converging surface and the inner converging surface may be configured to direct a hydrogen fuel from the hydrogen manifold into the combustion chamber at an angle $\alpha$ toward the axial centerline.

In any of the aspects or embodiments described above and herein, the outer converging surface may be oriented parallel to the inner converging surface.

In any of the aspects or embodiments described above and herein, one or both of the outer converging surface and the inner converging surface may be oriented at the angle $\alpha$ relative to the axial centerline.

In any of the aspects or embodiments described above and herein, the outer nozzle may further include a downstream axial portion extending from the outer diverging axial portion in a downstream direction. The downstream axial portion may have a constant diameter.

In any of the aspects or embodiments described above and herein, the inner nozzle may be axially translatable along the axial centerline relative to the outer nozzle.

In any of the aspects or embodiments described above and herein, the inner nozzle may be axially fixed relative to the outer nozzle.

In any of the aspects or embodiments described above and herein, the inner nozzle may extend through the hydrogen manifold.

In any of the aspects or embodiments described above and herein, the assembly may further include a turbine section of the gas turbine engine. The turbine section may be connected in fluid communication with the combustion chamber and configured to receive a combustion gas flow from the combustion chamber.

In any of the aspects or embodiments described above and herein, the outer diverging axial portion may extend along an average divergence angle $\Theta$ between four degrees and seven degrees relative to the axial centerline.

According to another aspect of the present disclosure, a gas turbine engine for an aircraft propulsion system includes a compressor section and at least one burner. The compressor section is configured to form a compressed air. The at least one burner includes a hydrogen manifold, an outer nozzle, and an inner nozzle. The outer nozzle extends circumferentially about an axial centerline to form a combustion chamber within the outer nozzle. The outer nozzle includes an outer converging axial portion. The outer converging axial portion is disposed at an upstream axial end of the outer nozzle. The upstream axial end is disposed at the hydrogen manifold. The inner nozzle extends circumferentially about the axial centerline to form an air passage along the axial centerline. The inner nozzle is connected in fluid communication with the compressor section and configured to direct the compressed air from the compressor section to the combustion chamber through the air passage. The inner nozzle includes an inner converging axial portion at a downstream axial end of the inner nozzle. The outer converging axial portion and the inner converging axial portion form an annular gap. The outer converging axial portion and the inner converging axial portion are configured to direct a hydrogen fuel from the hydrogen manifold to the combustion chamber through the annular gap.

In any of the aspects or embodiments described above and herein, the outer converging axial portion may extend between and to a first axial end and a second axial end. The downstream axial end may be disposed axially between the first axial end and the second axial end.

In any of the aspects or embodiments described above and herein, the outer converging portion may include an outer converging surface. The inner converging axial portion may include an inner converging surface. The outer converging surface and the inner converging surface may be configured to direct the hydrogen fuel from the hydrogen manifold into the combustion chamber at an angle $\alpha$ toward the axial centerline.

According to another aspect of the present disclosure, an assembly for a gas turbine engine includes at least one burner. The at least one burner includes an outer nozzle and an inner nozzle. The outer nozzle extends circumferentially about an axial centerline to form a combustion chamber within the outer nozzle. The outer nozzle includes an outer converging axial portion and an outer diverging axial portion. The outer converging axial portion is disposed at an upstream axial end of the outer nozzle. The outer diverging axial portion is disposed axially downstream of the outer converging axial portion. The inner nozzle extends circumferentially about the axial centerline. The inner nozzle includes an inner converging axial portion at a downstream axial end of the inner nozzle. The outer converging axial portion and the inner converging axial portion form an annular gap extending along an angle $\alpha$ toward the axial centerline.

In any of the aspects or embodiments described above and herein, the outer converging axial portion may extend between and to a first axial end and a second axial end. The downstream axial end may be disposed axially between the first axial end and the second axial end.

In any of the aspects or embodiments described above and herein, the outer diverging axial portion may extend between and to a first axial end and a second axial end. The first axial end may be disposed at the outer converging axial portion.

The present disclosure, and all its aspects, embodiments and advantages associated therewith will become more readily apparent in view of the detailed description provided below, including the accompanying drawings.

DETAILED DESCRIPTION

Figure 1:
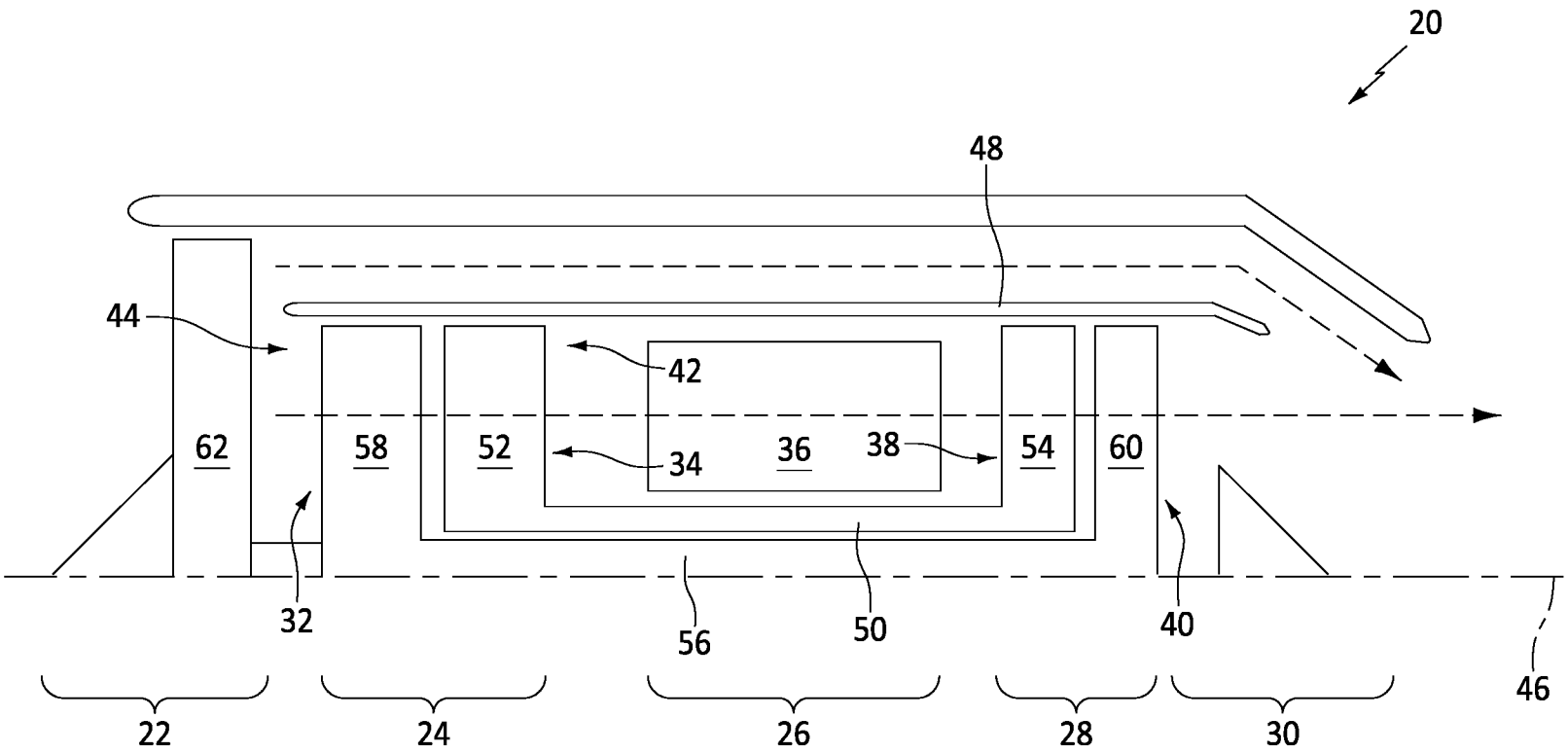
FIG. 1 illustrates a schematic cutaway view of a gas turbine engine for an aircraft propulsion system, in accordance with one or more embodiments of the present disclosure.

FIG. 1 schematically illustrates a gas turbine engine 20. The gas turbine engine 20 of FIG. 1 is a multi-spool turbofan gas turbine engine for an aircraft propulsion system. However, while the following description and accompanying drawings may refer to the turbofan gas turbine engine 20 of FIG. 1 as an example, it should be understood that aspects of the present disclosure may be equally applicable to other types of gas turbine engines including, but not limited to, a turboshaft gas turbine engine, a turboprop gas turbine engine, a turbojet gas turbine engine, a propfan gas turbine engine, or an open rotor gas turbine engine.

The gas turbine engine 20 of FIG. 1 includes a fan section 22, a compressor section 24, a combustor section 26, a turbine section 28, and an exhaust section 30. The compressor section 24 includes a low-pressure compressor (LPC) 32 and a high-pressure compressor (HPC) 34. The combustor section 26 includes at least one burner 36. The turbine section 28 includes a high-pressure turbine (HPT) 38 and a low-pressure turbine (LPT) 40.

The gas turbine engine 20 sections 22, 24, 28 form a first rotational assembly 42 (e.g., a high-pressure spool) and a second rotational assembly 44 (e.g., a low-pressure spool) of the gas turbine engine 20. The first rotational assembly 42 and the second rotational assembly 44 are mounted for rotation about a rotational axis 46 (e.g., an axial centerline of the gas turbine engine 20) relative to an engine static structure 48 of the gas turbine engine 20. The engine static structure 48 may include one or more engine cases, cowlings, bearing assemblies, and/or other non-rotating structures configured to house and/or support components of the gas turbine engine 20 sections 22, 24, 26, 28.

The first rotational assembly 42 includes a first shaft 50, a bladed first compressor rotor 52 for the high-pressure compressor 34, and a bladed first turbine rotor 54 for the high-pressure turbine 38. The first shaft 50 interconnects the bladed first compressor rotor 54 and the bladed first turbine rotor 56.

The second rotational assembly 44 includes a second shaft 56, a bladed second compressor rotor 58 for the low-pressure compressor 32, and a bladed second turbine rotor 60 for the low-pressure turbine 40. The second shaft 56 interconnects the bladed second compressor rotor 58 and the bladed second turbine rotor 60. The second shaft 56 may additionally be directly or indirectly coupled to a bladed fan rotor 62 for the fan section 22. For example, the second shaft 56 may be coupled to the bladed fan rotor 62 (e.g., an input shaft of the bladed fan rotor 62) by a reduction gear assembly configured to drive the bladed fan rotor 62 at a reduced rotational speed relative to the second shaft 56.

In operation of the gas turbine engine 20 of FIG. 1, ambient air is directed through the fan section 22 and into a core flow path 64 and a bypass flow path 66 by rotation of the bladed fan rotor 62. Airflow along the core flow path 64 is compressed by the low-pressure compressor 32 and the high-pressure compressor 34, mixed and burned with fuel in the burner 36 (or burners 36), and then directed through the high-pressure turbine 38 and the low-pressure turbine 40. The bladed first turbine rotor 54 and the bladed second turbine rotor 60 rotationally drive the first rotational assembly 42 and the second rotational assembly 44, respectively, in response to the combustion gas flow through the high-pressure turbine 38 and the low-pressure turbine 40. The first shaft 50 and the second shaft 56 are concentric and rotate about the rotational axis 46. The present disclosure, however, is not limited to concentric configurations of the first shaft 50 and the second shaft 56 and the first shaft 50 and the second shaft 56 may alternatively be configured for rotation about discrete rotational axes. The combustion gas flow through the high-pressure turbine 38 and the low-pressure turbine 40 is directed out of the gas turbine engine 20 through the exhaust section 30.

The present disclosure burner 36 is configured to use hydrogen ($H_2$) as a fuel for combustion within the burner 36. In comparison to conventional hydrocarbon-based aircraft gas turbine engine fuels (e.g., kerosene), hydrogen has a flame propagation rate which is approximately 20 to 100 times faster. The high hydrogen flame velocity allows a combustion flame to attach to solid surfaces (e.g., burner or combustor walls) even under high-velocity crossflow shear. While the radiant heat emitted from a hydrogen fuel flame may be lower than the radiant heat emitted by a hydrocarbon fuel flame, direct contact between a hydrogen fuel flame and solid burner components (e.g., an outer wall of the burner) may still lead to damage or degradation of these solid burner components. In at least some conventional burner configurations, active cooling systems have been used to cool burner components exposed to hydrogen fuel flames. For example, water cooling systems have been used to cool burner components. However, these active cooling systems negatively contribute to propulsion system weight, cost, and manufacturing and operational complexity (e.g., by requiring a water tank, delivery, and metering system). While the present disclosure burner 36 is described herein using hydrogen fuel for combustion, the burner 36 may configured to use one or more additional fuels (e.g., hydrocarbon fuels such as kerosene) in combination with hydrogen.

Figure 2:
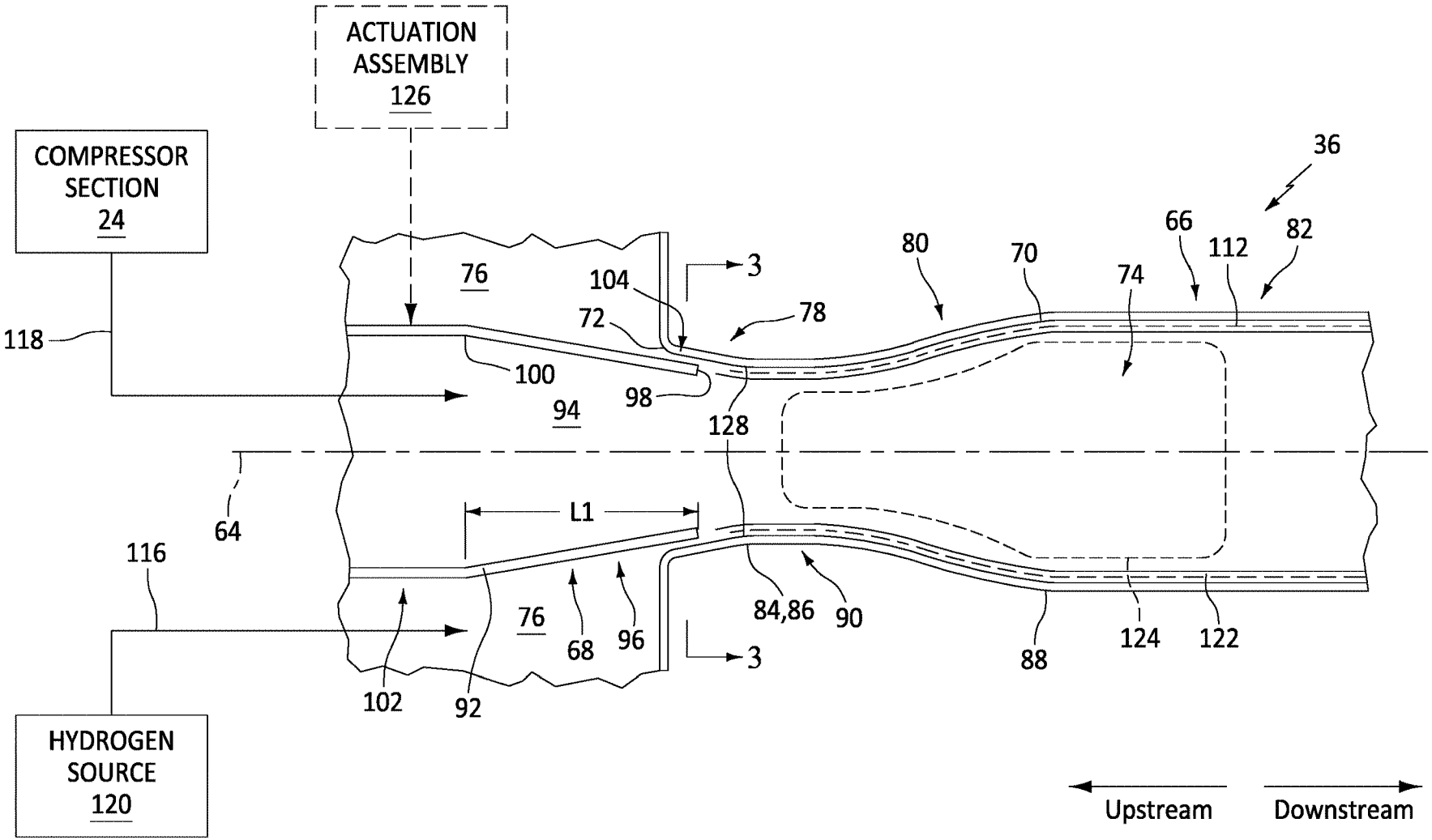
FIG. 2 illustrates a side, cutaway view of a burner for a combustor section of a gas turbine engine, in accordance with one or more embodiments of the present disclosure.

FIG. 2 illustrates a cutaway view of the burner 36 along an axial centerline 64 of the burner 36. The burner 36 of FIG. 2 includes an outer wall 66 and an inner nozzle 68. The axial centerline 64 may be the same as or different than the rotational axis 46 (see FIG. 1).

The outer wall 66 extends circumferentially about (e.g., completely around) the axial centerline 64. The outer wall 66 forms an outer nozzle 70. The outer nozzle 70 extends axially downstream from an upstream axial end 72 of the outer nozzle 70. The terms "upstream" and "downstream," as used herein with respect to the burner 36, refer to a general direction of fluid flow (e.g., air, hydrogen, fuel, etc.) through the burner 36 during operation of the gas turbine engine 20 (see FIG. 1). The outer nozzle 70 surrounds and forms a combustion chamber 74 of the burner 36, which combustion chamber 74 extends along the axial centerline 64. The upstream axial end 72 is disposed at (e.g., on, adjacent, or proximate) a hydrogen manifold 76. The outer wall 66 may form a portion of a housing for the hydrogen manifold 76, however, the present disclosure is not limited to this particular configuration of the outer wall 66. The hydrogen manifold 76 may extend circumferentially about (e.g., completely around) the axial centerline 64 at (e.g., on, adjacent, or proximate) the upstream axial end 72. The hydrogen manifold 76 is connected in fluid communication with the combustion chamber 74 to direct a hydrogen fuel flow into the combustion chamber 74, as will be discussed in further detail. The outer nozzle 70 includes a converging axial portion 78, a diverging axial portion 80, and a downstream axial portion 82.

The converging axial portion 78 forms an inlet of the outer nozzle 70. The converging axial portion 78 extends (e.g., axially extends) from the upstream axial end 72 to a downstream axial end 84 of the converging axial portion 78. The converging axial portion 78 extends circumferentially about (e.g., completely around) the axial centerline 64. The converging axial portion 78 surrounds and forms a portion (e.g., an axial portion) of the combustion chamber 74. The converging axial portion 78 converges radially toward the axial centerline 64 in a direction from the upstream axial end 72 to the downstream axial end 84 such that the downstream axial end 84 is disposed radially inward of the upstream axial end 72. The converging axial portion 78 may converge (e.g., continuously converge) from the upstream axial end 72 to the downstream axial end 84. Accordingly, a diameter of the combustion chamber 74 at the upstream axial end 72 is greater than a diameter of the combustion chamber 74 at the downstream axial end 84.

The diverging axial portion 80 is disposed axially downstream of the converging axial portion 78. The diverging axial portion 80 extends (e.g., axially extends) from an upstream axial end 86 of the diverging axial portion 80 to a downstream axial end 88 of the diverging axial portion 80. For example, the upstream axial end 86 may be disposed at (e.g., on, adjacent, or proximate) the downstream axial end 84 such that the diverging axial portion extends (e.g., axially extends) from the downstream axial end 84 to the downstream axial end 88. The diverging axial portion 86 may include a constant-diameter axial portion 90. The constant-diameter axial portion 90 may be disposed at (e.g., on, adjacent, or proximate) the upstream axial end 86.

The outer nozzle 70 forms a continuous curvature surface 128 (e.g., a second-derivative curvature surface) at an intersection of the converging axial portion 78 and the diverging axial portion 80 (e.g., portions of the converging axial portion 78 and the diverging axial portion 80 including the downstream axial end 84 and the upstream axial end 86). In other words, the flow surface interface of the converging axial portion 78 and the diverging axial portion 80 does not include any sharp angles, edges, steps, or the like. The continuous curvature surface 128 extends circumferentially about (e.g., completely around) the axial centerline 64.

The diverging axial portion 80 extends circumferentially about (e.g., completely around) the axial centerline 64. The diverging axial portion 80 surrounds and forms a portion (e.g., an axial portion) of the combustion chamber 74. The diverging axial portion 80 diverges radially from the axial centerline 64 in a direction from the upstream axial end 86 to the downstream axial end 88 such that the downstream axial end 88 is disposed radially outward of the upstream axial end 86. The diverging axial portion 80 may diverge (e.g., continuously diverge) from the upstream axial end 86 to the downstream axial end 88. Accordingly, a diameter of the combustion chamber 74 at the upstream axial end 86 is less than a diameter of the combustion chamber 74 at the downstream axial end 88. The diverging axial portion 80 (e.g., an inner radial surface of the outer wall 66 in the diverging axial portion 80) may be oriented at a divergence angle $\Theta$ relative to the axial centerline 64. For example, the divergence angle $\Theta$ may represent an average orientation of the diverging axial portion 80 relative to the axial centerline 64 extending from the upstream axial end 86 to the downstream axial end 88. The divergence angle $\Theta$ may be in a range between four and seven degrees (4-7°), however, the present disclosure is not limited to this particular divergence angle $\Theta$.

The downstream axial portion 82 extends (e.g., axially extends) axially downstream from the downstream axial end 88. The downstream axial portion 82 extends circumferentially about (e.g., completely around) the axial centerline 64. The downstream axial portion 82 surrounds and forms a portion (e.g., an axial portion) of the combustion chamber 74. The downstream axial portion 82 may have a cylindrical or substantially cylindrical shape. For example, the combustion chamber 74 may have a constant diameter axially throughout the downstream axial portion 82.

The inner nozzle 68 includes a nozzle body 92. The nozzle body 92 extends circumferentially about (e.g., completely around) the axial centerline 64. The nozzle body 92 surrounds and forms an air passage 94 of the inner nozzle 68, which air passage 94 extends along the axial centerline 64. The air passage 94 is connected in fluid communication with the compressor section 24 (e.g., the high-pressure compressor 34) to receive compressed air from the compressor section 24 (see FIG. 1). The nozzle body 92 is configured to direct the compressed air from the air passage 94 into the combustion chamber 74, as will be discussed in further detail. The nozzle body 92 may form a portion of or otherwise be disposed within the hydrogen manifold 76.

The nozzle body 92 includes a converging axial portion 96 at (e.g., on, adjacent, or proximate) a downstream axial end 98 (e.g., a distal end) of the nozzle body 92. The converging axial portion 96 extends (e.g., axially extends) from an upstream axial end 100 of the converging axial portion 96 to the downstream axial end 98. The converging axial portion 96 has a length L1 extending between and to the upstream axial end 100 and the downstream axial end 98 along the axial centerline 64. The converging axial portion 96 extends circumferentially about (e.g., completely around) the axial centerline 64. The converging axial portion 96 surrounds and forms a portion (e.g., an axial portion) of the air passage 94. The converging axial portion 96 converges radially toward the axial centerline 64 in a direction from the upstream axial end 100 to the downstream axial end 98 such that the downstream axial end 98 is disposed radially inward of the upstream axial end 100. The converging axial portion 96 may converge (e.g., continuously converge) from the upstream axial end 100 to the downstream axial end 98. Accordingly, a diameter of the air passage 94 at the upstream axial end 98 is greater than a diameter of the air passage 94 at the downstream axial end 98. The nozzle body 92 may additionally include an upstream axial portion 102 extending (e.g., axially extending) in an upstream direction from the upstream axial end 100. The upstream axial portion 102 of FIG. 2 has a generally cylindrical shape, however, the present disclosure is not limited to any particular configuration of the upstream axial portion 102.

Figure 3:
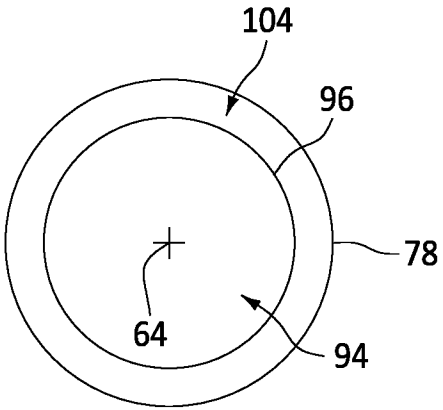
FIG. 3 illustrates a cross-sectional view of the burner of FIG. 2 taken along Line 3-3 of FIG. 2, in accordance with one or more embodiments of the present disclosure.

The converging axial portion 96 is disposed radially inward of the converging axial portion 78 to form an annular gap 104 between the converging axial portion 96 and the converging axial portion 78. FIG. 3 illustrates a cross-sectional view of the burner 36 showing the annular gap 104. The annular gap 104 extends circumferentially about (e.g., completely around) the axial centerline 64. The inner nozzle 68 is disposed relative to the outer nozzle 70 with the downstream axial end 98 disposed axially between (e.g., axially spaced from) the upstream axial end 72 and the downstream axial end 84. The upstream axial end 96 is disposed axially upstream of the upstream axial end 72.

Figure 4:
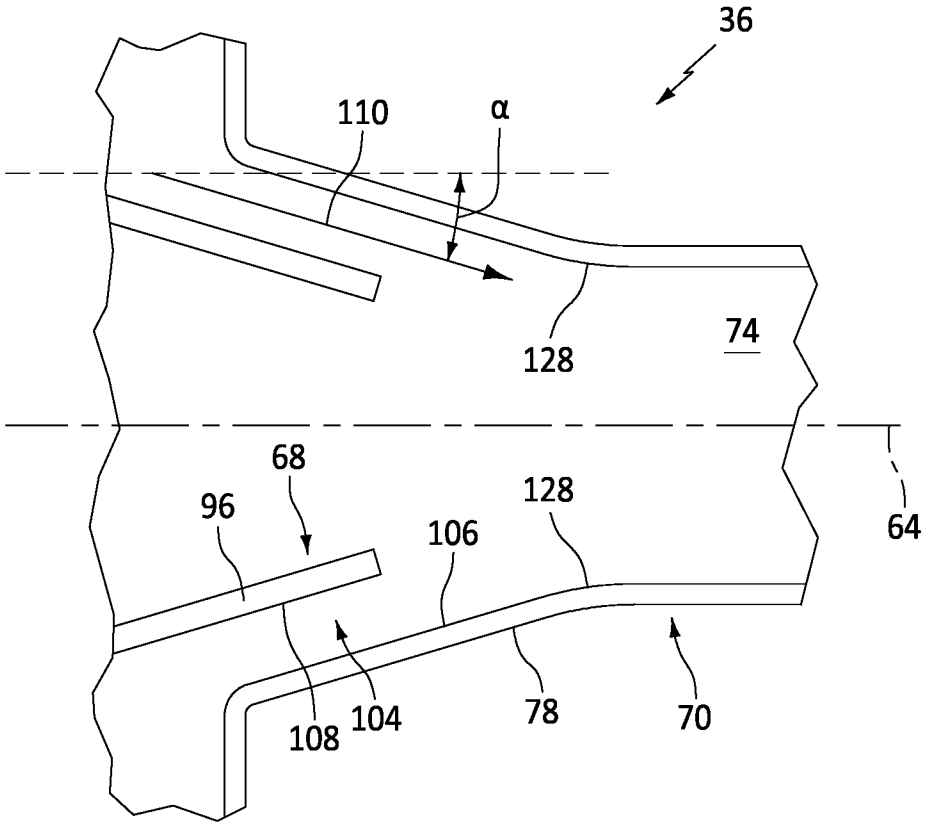
FIG. 4 illustrates another side, cutaway view of the burner of FIG. 2, in accordance with one or more embodiments of the present disclosure.

FIG. 4 illustrates another cutaway view of the burner 36 in greater detail at the location of the annular gap 104. The converging axial portion 78 of the outer nozzle 70 includes an outer converging surface 106 facing the converging axial portion 96 of the inner nozzle 68. The converging axial portion 96 of the inner nozzle 68 includes an inner converging surface 108 facing the converging axial portion 78 of the outer nozzle 70. The outer converging surface 106 and the inner converging surface 108 form the annular gap 104. The outer converging surface 106 and the inner converging surface 108 may be oriented parallel or substantially parallel to one another. The outer converging surface 106 and the inner converging surface 108 are configured to direct a hydrogen fuel flow 110 through the annular gap 104 into the combustion chamber 74. The hydrogen fuel flow 110 is schematically illustrated in FIG. 4 using a hydrogen fuel flow vector indicating a general direction of hydrogen gas flow through the annular gap 104 and into the combustion chamber 74. The hydrogen fuel flow 110 is directed through the annular gap 104 and into the combustion chamber 74 in a direction toward the axial centerline 64. In particular, the hydrogen fuel flow 110 is directed through the annular gap 104 and into the combustion chamber 74 at an angle $\alpha$ relative to the axial centerline 64, as shown in FIG. 4. One or both of the outer converging surface 106 and the inner converging surface 108 may extend parallel to or substantially parallel to (e.g., +/−five degrees (5°)) the angle $\alpha$ in an upstream to downstream direction. The angle $\alpha$ is not limited to any particular value (e.g., the angle $\alpha$ may be greater than 0 degrees and less than 90 degrees), however, orientations of the outer converging surface 106 and the inner converging surface 108 may be selected to determine the angle $\alpha$ for different applications. As an example, the angle $\alpha$ for the burner 26 may be determined based on an expected Reynolds number (e.g., a ratio of inertial and viscous forces of a fluid flow) for fluid (e.g., hydrogen) flow through the burner 36 during operation of the burner 36. For smaller gas turbine engines, the expected Reynolds number may be relatively smaller and, therefore, a value of the angle $\alpha$ may also be relatively smaller. For larger gas turbine engines, the expected Reynolds number may be relatively larger and, therefore, a value of the angle $\alpha$ may also be relatively larger.

Referring again to FIG. 2, in operation of the burner 36, the inner nozzle 68 and the outer nozzle 70 direct a hydrogen fuel 116 and a compressed air 118 into the combustion chamber 74 for mixing and combustion within the combustion chamber 74. The hydrogen fuel 116 may be supplied to the hydrogen manifold 76 from a hydrogen source 120 (e.g., a pressurized hydrogen storage tank) connected in fluid communication with the hydrogen manifold 76. The hydrogen source 120 may be connected in fluid communication with the hydrogen manifold 76, in part, by one or more valves, regulators, or other fluid control devices to modulate a flow rate and/or pressure of the hydrogen fuel 116 supplied to the hydrogen manifold 76. The hydrogen fuel 116 stored by the hydrogen source 120 may be pure or substantially pure hydrogen (e.g., a fuel which is greater than or equal to ninety percent hydrogen by volume). The hydrogen fuel 116 is directed into the combustion chamber 74 through the annular gap 104 by the outer converging surface 106 and the inner converging surface 108 along the angle $\alpha$ (see FIG. 4). The compressed air 118 from the compressor section 24 (e.g., the high-pressure compressor 34) is directed through the air passage 94 into the combustion chamber 74 by the inner nozzle 68. The hydrogen fuel 116 mixes with the compressed air 118 downstream of the inner nozzle 68 (e.g., the downstream axial end 98).

In general, the hydrogen fuel 116 and the compressed air 118 may be directed into the combustion chamber 74 to achieve a hydrogen-to-air stoichiometric ratio of approximately 4:1 to approximately 10:1. The present disclosure, however, is not limited to any particular hydrogen-to-air stoichiometric ratio. A flow rate of the hydrogen fuel 116 into the combustion chamber 74 may be controlled, for example, by controlling a flow rate of the hydrogen fuel 116 supplied to the hydrogen manifold 76 by the hydrogen source 120. Additionally or alternatively, the flow rate of the hydrogen fuel 116 into the combustion chamber 74 may be controlled by controlling an axial position of the inner nozzle 68 relative to the outer nozzle 70. For example, the burner 36 may include an actuation assembly 126 configured to effect translation of the inner nozzle 68 along the axial centerline 64 to control a size (e.g., a cross-sectional area perpendicular to the axial centerline 64) of the annular gap 104, thereby controlling a flow rate of the hydrogen fuel 116 through the annular gap 104. The actuation assembly 126 may be formed by any linear actuation assembly conventionally known in the art (e.g., a hydraulic actuation assembly, a pneumatic actuation assembly, an electro-mechanical actuation assembly, etc.), and the present disclosure is not limited to any particular configuration of the actuation assembly 126. Alternatively, the inner nozzle 68 may be positionally (e.g., axially) fixed relative to the outer nozzle 70.

As the hydrogen fuel 116 is directed into the combustion chamber 74 within the converging axial portion 78 and at the angle $\alpha$, at least some of the hydrogen fuel 116 remains attached to and flows along the outer wall 66, thereby forming a hydrogen film 122 along the outer wall 66. The continuous curvature surface 128 and the angle $\alpha$ of the hydrogen fuel 116 guide a portion of the hydrogen fuel 116 onto the outer wall 66 without substantial mixing of the portion of the hydrogen fuel 116 with other gases in the combustion chamber 74, thereby facilitating the formation of the hydrogen film 122 along the outer wall 66. At a same velocity, the hydrogen fuel 116 forming the hydrogen film 122 may have a significantly lower Reynolds number (e.g., a ratio of inertial and viscous forces of a fluid flow) in comparison to the compressed air 118, thereby facilitating stability of the hydrogen film 122 along the outer wall 66 for all or a substantial portion of an axial length of the combustion chamber 74. Instead of mixing with the compressed air 118 and combusting, the hydrogen fuel 116 forming the hydrogen film 122 may form a relatively cooler fluid barrier along the outer wall 66, thereby protecting the outer wall 66 from flame contact and from the relatively hotter combustion gases (e.g., high-temperature $H_2O$, $N_2$, and $O_2$) found in a high-temperature combustion region 124 of the combustion chamber 74. The configuration of the inner nozzle 68 and the outer nozzle 70 for directing the hydrogen fuel 116 into the combustion chamber 74 further facilitates flame stability within the combustion chamber 74 by maintaining a high-turbulence backflow region (e.g., a trapped vortex) within the high-temperature combustion region 124, which facilitates continuous re-ignition and fuel-air mixing. This high-turbulence backflow region is bounded and stabilized by the incoming compressed air 118 in upstream axial direction and by the cold hydrogen film 122 in the outer radial direction.

While the principles of the disclosure have been described above in connection with specific apparatuses and methods, it is to be clearly understood that this description is made only by way of example and not as limitation on the scope of the disclosure. Specific details are given in the above description to provide a thorough understanding of the embodiments. However, it is understood that the embodiments may be practiced without these specific details.

It is noted that the embodiments may be described as a process which is depicted as a flowchart, a flow diagram, a block diagram, etc. Although any one of these structures may describe the operations as a sequential process, many of the operations can be performed in parallel or concurrently. In addition, the order of the operations may be rearranged. A process may correspond to a method, a function, a procedure, a subroutine, a subprogram, etc.

The singular forms "a," "an," and "the" refer to one or more than one, unless the context clearly dictates otherwise. For example, the term "comprising a specimen" includes single or plural specimens and is considered equivalent to the phrase "comprising at least one specimen." The term "or" refers to a single element of stated alternative elements or a combination of two or more elements unless the context clearly indicates otherwise. As used herein, "comprises" means "includes." Thus, "comprising A or B," means "including A or B, or A and B," without excluding additional elements.

It is noted that various connections are set forth between elements in the present description and drawings (the contents of which are included in this disclosure by way of reference). It is noted that these connections are general and, unless specified otherwise, may be direct or indirect and that this specification is not intended to be limiting in this respect. Any reference to attached, fixed, connected or the like may include permanent, removable, temporary, partial, full and/or any other possible attachment option.

No element, component, or method step in the present disclosure is intended to be dedicated to the public regardless of whether the element, component, or method step is explicitly recited in the claims. No claim element herein is to be construed under the provisions of 35 U.S.C. 112(f) unless the element is expressly recited using the phrase "means for." As used herein, the terms "comprise", "comprising", or any other variation thereof, are intended to cover a non-exclusive inclusion, such that a process, method, article, or apparatus that comprises a list of elements does not include only those elements but may include other elements not expressly listed or inherent to such process, method, article, or apparatus.

While various inventive aspects, concepts and features of the disclosures may be described and illustrated herein as embodied in combination in the exemplary embodiments, these various aspects, concepts, and features may be used in many alternative embodiments, either individually or in various combinations and sub-combinations thereof. Unless expressly excluded herein all such combinations and sub-combinations are intended to be within the scope of the present application. Still further, while various alternative embodiments as to the various aspects, concepts, and features of the disclosures—such as alternative materials, structures, configurations, methods, devices, and components, and so on—may be described herein, such descriptions are not intended to be a complete or exhaustive list of available alternative embodiments, whether presently known or later developed. Those skilled in the art may readily adopt one or more of the inventive aspects, concepts, or features into additional embodiments and uses within the scope of the present application even if such embodiments are not expressly disclosed herein. For example, in the exemplary embodiments described above within the Detailed Description portion of the present specification, elements may be described as individual units and shown as independent of one another to facilitate the description. In alternative embodiments, such elements may be configured as combined elements.

What is claimed is:

1. An assembly for a gas turbine engine, the assembly comprising:

at least one burner including:

an outer nozzle extending circumferentially about an axial centerline to form a combustion chamber within the outer nozzle, the outer nozzle includes an outer converging axial portion and an outer diverging axial portion, the outer converging axial portion is disposed at an upstream axial end of the outer nozzle, and the outer diverging axial portion is disposed axially downstream of the outer converging axial portion; and an inner nozzle extending circumferentially about the axial centerline, the inner nozzle including an inner converging axial portion at a downstream axial end of the inner nozzle, and the inner converging axial portion is disposed within the outer converging axial portion to form an annular gap between the outer converging axial portion and the inner converging axial portion; and a hydrogen manifold disposed at the upstream axial end, and the hydrogen manifold is connected in fluid communication with the annular gap;

wherein the outer diverging axial portion extends between and to a first axial end and a second axial end, and the first axial end is disposed at the outer converging axial portion, and the outer nozzle forms a continuous curvature surface at an intersection of the outer diverging axial portion and the outer converging axial portion.

2. The assembly of claim 1, wherein the outer converging axial portion extends between and to a first axial end and a second axial end, and the downstream axial end is disposed axially between the first axial end and the second axial end.

3. The assembly of claim 1, further comprising a compressor section, wherein the inner nozzle surrounds and forms an air passage along the axial centerline, and the inner nozzle is connected in fluid communication with the compressor section and configured to direct a compressed air from the compressor section into the combustion chamber through the air passage.

4. The assembly of claim 1, wherein the outer converging portion includes an outer converging surface, the inner converging axial portion includes an inner converging surface, and the outer converging surface and the inner converging surface are configured to direct a hydrogen fuel from the hydrogen manifold into the combustion chamber at an angle $\alpha$ toward the axial centerline.

5. The assembly of claim 4, wherein the outer converging surface is oriented parallel to the inner converging surface.

6. The assembly of claim 4, wherein one or both of the outer converging surface and the inner converging surface is oriented at the angle $\alpha$ relative to the axial centerline.

7. The assembly of claim 1, wherein the outer nozzle further includes a downstream axial portion extending from the outer diverging axial portion in a downstream direction, and the downstream axial portion has a constant diameter.

8. The assembly of claim 1, wherein the inner nozzle is axially translatable along the axial centerline relative to the outer nozzle.

9. The assembly of claim 1, wherein the inner nozzle is axially fixed relative to the outer nozzle.

10. The assembly of claim 1, wherein the inner nozzle extends through the hydrogen manifold.

11. The assembly of claim 1, further comprising a turbine section, the turbine section connected in fluid communication with the combustion chamber and configured to receive a combustion gas flow from the combustion chamber.

12. The assembly of claim 1, wherein the outer diverging axial portion extends along an average divergence angle $\Theta$ between four degrees and seven degrees relative to the axial centerline.

13. A gas turbine engine for an aircraft propulsion system, the gas turbine engine comprising:

a compressor section configured to form a compressed air; and at least one burner including:

a hydrogen manifold;

an outer nozzle extending circumferentially about an axial centerline to form a combustion chamber within the outer nozzle, the outer nozzle includes an outer converging axial portion, the outer converging axial portion is disposed at an upstream axial end of the outer nozzle, and the upstream axial end is disposed at the hydrogen manifold; and an inner nozzle extending circumferentially about the axial centerline to form an air passage along the axial centerline, the inner nozzle is connected in fluid communication with the compressor section and configured to direct the compressed air from the compressor section to the combustion chamber through the air passage, and the inner nozzle includes an inner converging axial portion at a downstream axial end of the inner nozzle;

the outer converging axial portion and the inner converging axial portion form an annular gap, and the outer converging axial portion and the inner converging axial portion are configured to direct a hydrogen fuel from the hydrogen manifold to the combustion chamber through the annular gap.

14. The gas turbine engine of claim 13, wherein the outer converging axial portion extends between and to a first axial end and a second axial end, and the downstream axial end is disposed axially between the first axial end and the second axial end.

15. The gas turbine engine of claim 13, wherein the outer converging portion includes an outer converging surface, the inner converging axial portion includes an inner converging surface, and the outer converging surface and the inner converging surface are configured to direct the hydrogen fuel from the hydrogen manifold into the combustion chamber at an angle $\alpha$ toward the axial centerline.

16. An assembly for a gas turbine engine, the assembly comprising:

at least one burner including:

an outer nozzle extending circumferentially about an axial centerline to form a combustion chamber within the outer nozzle, the outer nozzle includes an outer converging axial portion and an outer diverging axial portion, the outer converging axial portion is disposed at an upstream axial end of the outer nozzle, and the outer diverging axial portion is disposed axially downstream of the outer converging axial portion; and an inner nozzle extending circumferentially about the axial centerline, the inner nozzle including an inner converging axial portion at a downstream axial end of the inner nozzle;

the outer converging axial portion and the inner converging axial portion form an annular gap extending along an angle $\alpha$ toward the axial centerline;

wherein the outer diverging axial portion extends along an average divergence angle $\Theta$ between four degrees and seven degrees relative to the axial centerline.

17. The assembly of claim 16, wherein the outer converging axial portion extends between and to a first axial end and a second axial end, and the downstream axial end is disposed axially between the first axial end and the second axial end.

18. The assembly of claim 16, wherein the outer diverging axial portion extends between and to a first axial end and a second axial end, and the first axial end is disposed at the outer converging axial portion.

* * * * *